United States Patent [19]

Engle et al.

[11] Patent Number: 4,741,116

[45] Date of Patent: May 3, 1988

[54] SNOWPLOW WING ASSEMBLY

[76] Inventors: Edward P. Engle, 1201 Shortline Dr., Fort Lupton, Colo. 80621; Lester O. Dowler, 4061 Sunrise La., Brighton, Colo. 80601

[21] Appl. No.: 46,745

[22] Filed: May 7, 1987

[51] Int. Cl.[4] ..... E01H 5/06

[52] U.S. Cl. ..... 37/280; 37/281; 172/701.1

[58] Field of Search ..... 77/280, 281, 266; 172/701.1, 113, 777, 784

[56] References Cited

U.S. PATENT DOCUMENTS

| | | | |
|---|---|---|---|
| 2,092,990 | 9/1937 | Southwick | 37/280 |
| 3,055,126 | 9/1962 | Emhof | 37/280 |
| 3,216,337 | 11/1965 | MacDonald | 37/280 X |
| 3,279,104 | 10/1966 | Wandscheer et al. | 37/281 X |
| 4,073,077 | 2/1978 | Essel et al. | 37/281 |
| 4,077,139 | 3/1978 | Fagervold et al. | 37/280 |
| 4,145,825 | 3/1979 | Bertolino | 37/280 |
| 4,275,514 | 5/1981 | Maura | 37/281 |

*Primary Examiner*—Edgar S. Burr
*Assistant Examiner*—Moshe I. Cohen
*Attorney, Agent, or Firm*—Henderson & Sturm

[57] ABSTRACT

A snow plow wing assembly (10) comprising a pair of heavy duty plow wing extension units (11) adapted to be secured at a fixed angle relative to a conventional vehicle mounted snow plow (100) wherein each of the extension units (11) comprise a blade element (12), a mounted bracket (13); a brace element (14) extending between the blade element (12) and the mounting bracket (13); a stabilizing arm (15); a resilient guard element (16); and releasable securing means (50) for attaching the wing assembly (10) to the vehicle mounted snow plow (100).

1 Claim, 1 Drawing Sheet

SNOWPLOW WING ASSEMBLY

TECHNICAL FIELD

The present invention relates to extension elements for expanding the effective width of a snow plow blade.

BACKGROUND OF THE INVENTION

As can be seen by reference to the following U.S. Pat. Nos: 4,073,077; 4,275,514; 4,145,825; and, 4,077,139 the prior art is replete with myriad and diverse auxiliary constructions that were developed to expand or otherwise improve the blade configuration of snow plow blades.

While all of the aforementioned prior art constructions are adequate for this intended purpose and function, they are also deficient in a number of individual respects due their own unique structural configurations.

Briefly stated, the prior art falls into two broad categories, the non-articulated extensible blade assemblies and the articulated extensible blade assemblies. In the latter instance, the articulated blade constructions employ hydraulic cylinders and mechanical linkages that, while providing a wide variety of blade configurations and angular dispositions of the extension element relative to the main plow blade, also require relatively complex hydraulic control mechanisms to effect the desired angular shifts between the respective components. Even in the instance of the non-articulated extensible blade assemblies, hydraulic components are sometimes employed to effect the lateral displacement of the extension elements relative to the main plow blade.

What the prior art has seemingly overlooked or ignored is the fact that a relatively simple approach to the problem of providing extension elements to a plow blade could be adopted that would produce comparable results to the more complex solutions at a fraction of the cost.

In addition, the prior art constructions also seem to have abandoned the precepts of common sense and logic in an attempt to solve this problem, and have consequently apparently adopted the concept that complexity is vastly superior to simplicity; and, the facts simply do not justify that conclusion based on a cost versus benefit rationale.

SUMMARY OF THE INVENTION

The present invention involves the use of a pair of heavy duty plow wing extension units that are dimensioned and configured to be attached on opposite sides of a conventional vehicle mounted snow plow blade; wherein, each of the plow wing extension units is provided with a blade element that is disposed at a fixed angle relative to the main plow blade.

Also, each of the plow wing extension units is further provided with a mounting bracket that fits flush with the ends of the plow blade, and a brace member that extends between the mounting bracket and the outboard end of the blade element, to provide rigidity and support to the extension unit relative to the plow blade.

In addition, the inboard end of each of the blade elements is provided with a stabilizing arm that is operatively secured to the main plow blade; and, the lower portion of the respective blade elements are further provided with enlarged resilient guard elements which extend substantially below the blade elements and beyond the outboard edges of the blade elements; wherein, the guard elements reduce the wear on the main plow blade, and further provide a protection barrier for outboard ends of the extension blade elements.

This invention further contemplates the use of releasable securing means for the rapid attachment and disengagement of either one or both of the plow wing extension units from a conventional vehicle mounted plow blade.

BRIEF DESCRIPTION OF THE DRAWINGS

These and other objects, advantages, and novel features of the invention will become apparent from the detailed description of the best mode for carrying out the preferred embodiment of this invention which follows: particularly when considered in conjunction with the accompanying drawings, wherein.

BEST MODE FOR CARRYING OUT THE INVENTION

Figure 1:
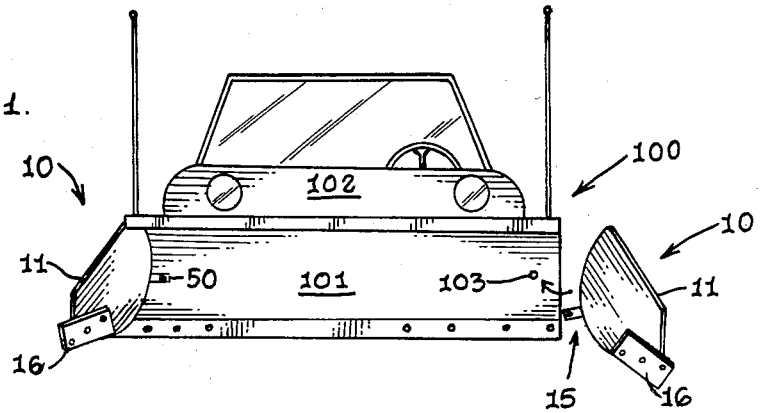
FIG. 1 is a perspective view of the invention deployed on a conventional vehicle mounted snow plow blade.

As can be seen by reference to the drawings and in particular to FIG. 1, the plow wing assembly that forms the basis of the present invention is designated generally by the reference numeral (10) and is specifically designed for use in conjunction with a conventional vehicle mounted snow plow (100) comprising an elongated generally C-shaped main snow plow blade (101) hydraulically mounted on a vehicle (102) such as a truck or the like.

Figure 4:
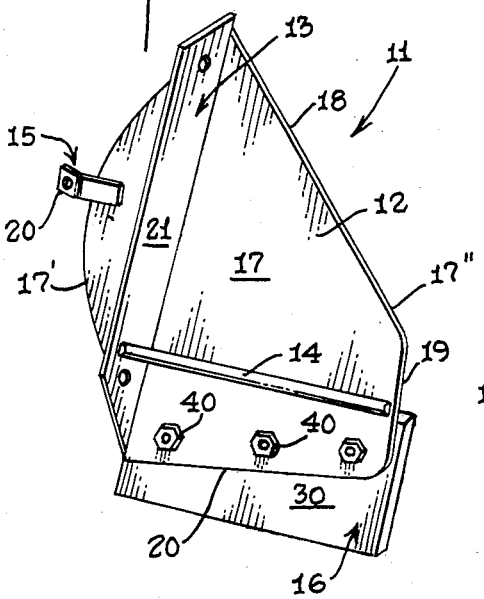
FIG. 4 is a perspective view of the rear of one of the extension units.
Figure 5:
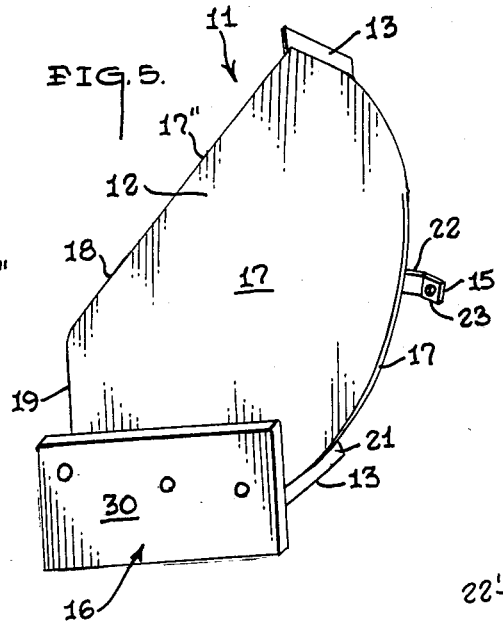
FIG. 5 is a perspective view of the front of one of the extension units; and, FIG. 6 is a top plan view of one of the extension units.

As also shown in FIG. 1, the plow wing assembly (10) comprises a pair of like configured heavy duty plow wing extension units (11) that are adapted to be releasably secured at a fixed angle relative to the main snow plow blade (101). As shown in FIGS. 4 and 5, each of the plow wing extension units (11) comprises in general: a wing blade element (12); a mounting bracket (13); a brace member (14) a stabilizing arm (15); and, a resilient guard element (16); and these structural components will now be described in seriatim fashion.

Still referring to FIGS. 4 and 5, it can be seen that the wing blade element (12) comprises a flat generally crescent shaped blade member (17) fabricated from metal; wherein, the trailing edge (17') of the blade member (17) is provided with an arcuate contour that is complementary with the C-shaped curvature of the main snow plow blade. The leading edge (17") of the blade member (17) is provided with an elongated angled portion (187) a relatively short generally vertical portion (19) and an intermediate length generally horizontal apertured portion (20).

Figure 6:
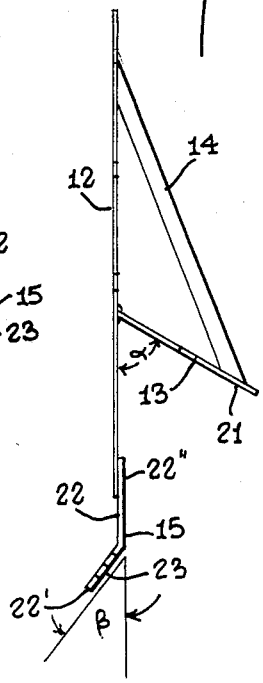

As shown in FIGS. 4 thru 6, the mounting bracket (13) comprises an elongated apertured metal plate (21) vertically disposed on the blade member (17) intermediate the leading (17") and trailing (17') edges of the blade member (17). In addition, the mounting bracket (13) projects outwardly from and is disposed at an angle of "α" with respect to the rear face of the blade element (12).

The brace member (14) comprises a metal rod (22) that is fixedly secured on its opposite ends to the mounting bracket (13) and the rear face of the blade element (12) proximate the vertical portion (19) of the leading edge (17″) of the blade element.

The stabilizing arm (15) of the assembly (10) comprises a relatively short angle arm member (22) whose outboard end (22′) is provided with an aperture (23). In addition, the inboard end (22″) of the angle arm member (22) is fixedly secured to the trailing edge (17′) of the blade element; and, the outboard end (22′) of the angle arm member (22) is disposed at an angle of (β) with respect to the inboard arm (22″) of the angle arm member (22).

In the preferred embodiment of this invention the angular disposition of the wing extension units (11) relative to the direction of travel of the conventional vehicular mounted plow (100) should fall in the range between 5° to 45°; and consequently the maximum combined values of "α" and "β" should be 90°.

The resilient guard element (16) comprises a generally rectangular thick rubber bumper element (30) that is fixedly secured to the lower portion of the front face of the blade element (12) by suitable fastening means (40); wherein the bumper element (16) projects substantially below the generally horizontal portion (20) of the leading edge (17″) of the blade element (12) and projects beyond the generally vertical portion (19) of the leading edge (17″) of the blade element (12).

Figure 2:
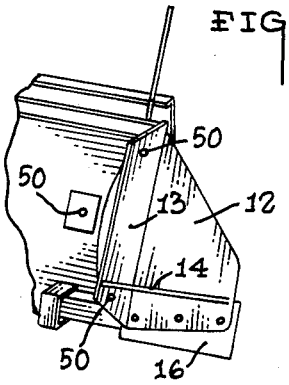
FIG. 2 is a perspective view of one of the extension units mounted on a plow blade.
Figure 3:
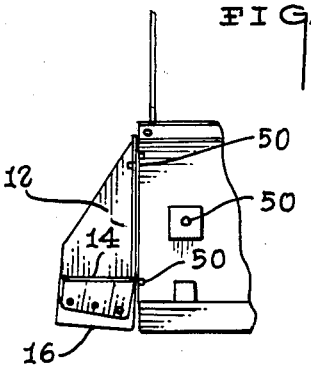
FIG. 3 is a rear view of one of the extension units mounted on a plow blade.

Turning now to FIGS. 1 thru 3, it can be appreciated that each of the extension wing units (11) are attached to the main plow blade (101) in the same fashion. Namely a plurality of apertures as at (103) are formed in the face (101) and at the outboard ends (not shown) of the main plow blade (101) wherein the apertures (103) will be aligned with complementary apertures on the stabilizing arm (22) and the mounting bracket (13).

Releasable securing means (50) are then inserted through the complementary apertures to operatively attach the stabilizing arms (22) to the face of the plow blade (101), and the mounting bracket (13) to the ends of the plow blade (103). In this manner the effective width of the main plow blade may be extended up to 25% by the installation of the angled wing units (11); and, the angled wing units (11) will reduce windrowing; and, improve the operator's visual perception and control relative to the areas that remain snow covered. In addition, the bumper elements (30) helps protect the main blade (101) by absorbing some of the wear that would normally be experienced by the main blade absent the wing units (11); as well as, offering additional protection against objects protruding into the path of the main blade. In addition, with the angled wing units (11) attached to the main blade (101) the amount of snow containment in the main blade (101) is greatly increased, making placement of snow more feasible.

Having thereby described the subject matter of this invention it should be apparent that many substitutions, modifications, and variations are possible in light of the above teachings. It is therefore to be understood that the invention as taught and described herein is only to be limited to the extent of the breadth and scope of the appended claims.

We claim:

1. A snow plow wing assembly in combination with a conventional generally C-shaped vehicle mounted snow plow wherein the wing assembly consists of:

a pair of heavy duty plow wing extension units wherein each of said extension units comprises: a generally flat blade element having a leading edge and a trailing edge; an apertured mounting bracket affixed to the rear of the blade element; wherein, the mounting bracket is vertically disposed on the blade element and angled away from said leading edge of the blade element; a brace member secured on one end to said blade element, and secured on the other end to said mounting bracket; a resilient guard element attached to the front of the blade element and extending below and projecting beyond the leading edge of the blade element; and securing means for operatively connecting the mounting bracket to the side of the conventional snow plow blade; whereby, the pair of plow wing units may be secured at a fixed angle relative to the direction of travel of the conventional snow plow blade; wherein, each of said pair of plow wing units further comprises:

a stabilizing arm attached to the trailing edge of said blade element and comprising an apertured angle arm member affixed on one end to said blade member and secured on the other end to the face of the conventional snow plow; wherein, said mounting bracket is disposed at an angle "α" relative to the blade element; the outboard end of the angled arm member is disposed at an angle of "β" with respect to the longitudinal axis of the inboard end of the angled arm member; and, the combined values of the angles "α" and "β" do not exceed 90°.

* * * * *